US005199059A

United States Patent [19]

Hohenauer

[11] Patent Number: 5,199,059

[45] Date of Patent: Mar. 30, 1993

[54] X-RAY TUBE ANODE WITH OXIDE COATING

[75] Inventor: Wolfgang Hohenauer, Kufstein, Austria

[73] Assignee: Schwarzkopf Technologies Corporation, New York, N.Y.

[21] Appl. No.: 795,760

[22] Filed: Nov. 21, 1991

[30] Foreign Application Priority Data

Nov. 22, 1990 [AT] Austria ..... 2367/90

[51] Int. Cl.[5] ..... H01J 35/10

[52] U.S. Cl. ..... 378/144; 378/143

[58] Field of Search ..... 378/129, 143, 144

[56] References Cited

U.S. PATENT DOCUMENTS

| | | | |
|---|---|---|---|
| 3,919,124 | 11/1975 | Freidel et al. | 252/520 |
| 3,993,923 | 11/1976 | Magendans et al. | 313/330 |
| 4,029,828 | 6/1977 | Bildstein et al. | 427/34 |
| 4,516,255 | 5/1985 | Petter et al. | 378/143 |
| 4,870,672 | 9/1989 | Lindberg | 378/129 |
| 4,953,190 | 8/1990 | Kukoleck et al. | 378/129 |

FOREIGN PATENT DOCUMENTS 0172491 2/1986 European Pat. Off. .

0244776 11/1987 European Pat. Off. .

*Primary Examiner*—Craig E. Church

*Attorney, Agent, or Firm*—Morgan & Finnegan

[57] ABSTRACT

The present invention relates to an oxide coating layer for improving the thermal emissivity of metallic X-ray tube anodes as well as improving the layer properties and effects displayed by the oxide coating. The oxide coating layer includes 1–20% by weight, and preferably, 4–7% by weight, of aluminum oxide. The layer additionally includes small proportions of other compounds and contains the oxides of the metals Ti and Zr and is applied to the x-ray anode by standard deposition processes. It is essential that the titanium dioxide content is less than 20% by weight of the oxide coating layer and the zirconium oxide content is greater than 60% by weight of the oxide coating layer. The coating layer may also include a stabilizing component, such as CaO. As a result, the deposition of such oxides or oxide mixtures is substantially better than hitherto known, and the anodes thus produced can be further processed to produce useable oxide layers without adverse effect to the important properties of layer adhesion and thermal emission coefficient.

4 Claims, No Drawings

X-RAY TUBE ANODE WITH OXIDE COATING

FIELD OF INVENTION

The invention relates to an X-ray anode, in particular a rotary anode, of high thermal emissivity, the X-ray anode having a parent body made of a refractory metal or its alloys, and a focal spot region or focal track region made of a refractory metal or its alloys, wherein the anode has an oxide coating formed as a homogeneous, fused phase which is deposited directly or via a base layer onto the parent body on at least parts of the surface outside the focal track, and wherein the oxide coating contains oxides of the metals Ti, Zr and Al and is optionally stabilized by a further oxide, such as CaO.

BACKGROUND

X-ray tube anodes emit only a fraction of the incoming radiated energy in the form of X-rays. The rest is converted into heat and has to leave the anode in the form of thermal radiation.

It has therefore been known for many years to improve the thermal emissivity of X-ray anodes made of refractory metals by means of an oxide coating (as described, for example, in Austrian Patent Specification 337 314, German Offenlegungsschrift 22 01 979, German Offenlegungsschrift 24 43 354). These prior disclosures separately describe and lay claim, by means of various oxide materials and manufacturing processes, to increase the adhesion of the oxide layer to the surface of the parent metal, as compared with the prior art, and to raise the thermal emissivity of the anode surface. However, it has been found that the performance of layers produced as described in the prior disclosures is limited in view of the continuously increasing requirements imposed on X-ray anodes with regard to layer ageing, heat radiating capability and also resistance to degassing (i.e., the avoidance of electrical flashovers).

German Offenlegungsschrift 22 01 979 describes, in particular, an oxide layer which is composed of a heating product containing titanium dioxide and additions of at least one other refractory oxide. Other suitable oxides are mentioned, such as aluminum oxide, calcium oxide, magnesium oxide and zirconium oxide. No mention is made of particular advantages experienced by any particular or special oxide combination. From the examples and the subordinate claims, it is to be concluded that a mixture of approximately equal parts of aluminum oxide and titanium dioxide is a preferred oxide mixture. In addition, it is to be concluded from the description that it is important for the titanium dioxide content not to drop below 20%.

EU A2 0 172 491 describes, in a further development, an X-ray anode made of a molybdenum alloy having an oxide coating composed of a mixture of 40%–70% titanium oxide, with the remainder being stabilizing oxides from the group comprising $ZrO_2$, HfO, MgO, $CeO_2$, $La_2O_3$ and SrO. In order to improve the achievement of the oxide layers with respect to the above-mentioned requirements imposed upon the layers, this prior disclosure sets as a particular object fusing the oxides to form smooth, brightly lustrous layers by means of economical processes.

EU A2 0 244 776 essentially relates to the same inventive subject. The invention relates to the pretreatment of the oxide material, before its application to the X-ray anode by means of standard spraying techniques. In this case, a mixture composed of 77%–85% titanium dioxide containing 15%–23% by weight of calcium oxide is processed in a first step to produce a powder containing a homogeneous phase. This mixture is then applied to the anode, being optionally mixed with other oxide powders, by known spraying processes. The reference describes various coating processes, such as plasma-jet spraying, sputtering processes, chemical and physical gas-phase deposition processes or even the electron beam process, as suitable for oxide coating of X-ray anodes made of refractory metals. Normally, an X-ray anode made of refractory metal is then subjected to a degassing annealing at the end of the production process. The degassing annealing of the anode serves to avoid gas emissions and, as a consequence thereof, highly undesirable plasma flashovers between the electrodes when the latter are used in high vacuum in an X-ray tube.

The inventive teaching of this prior disclosure implies that it is advantageous to match the material composition of the oxide layer to the annealing treatment applied after coating the X-ray anodes. These degassing annealings simultaneously serve for final formation and fusing of the oxide phase, i.e., the conversion of the oxide phase to a state which cannot be achieved solely by an oxide application process, such as the plasma-jet spraying process.

However, the layer composition according to this prior disclosure and the processes for producing it only inadequately meet the requirements imposed. On the contrary, during the annealing of the oxide layers according to this prior disclosure, there is the risk that, at an annealing temperature at which the oxides fuse to form smooth, well-adhering layers, the latter are already so fluid that the contour between coated and uncoated parts of the X-ray anode surface becomes ill-defined to an undesirable extent. Such ill-defined contours cannot be tolerated, in particular, in the region of the focal track.

In addition, such oxide layers experience troublesome gas phase formation at the required annealing temperatures.

U.S. Pat. No. 4,870,672 describes an oxidic coating for X-ray anodes, composed of a mixture of $Al_2O_3$, $ZrO_2$ and $TiO_2$. The preferred composition of the coating is composed of 40–70% by weight of $TiO_2$, 20–40% by weight of $ZrO_2$, and 10–20% by weight of $Al_2O_3$. The limit compositions of the coating are specified as 10–80% by weight of $TiO_2$, 10–60% by weight of $ZrO_2$, and 5–30% by weight of $Al_2O_3$. A disadvantage in the case of this coating is that, with an unfavorable choice of composition, evaporation of the coating may occur, with consequent condensation and flashover in the X-ray tube.

SUMMARY OF THE INVENTION

The object of the present invention is accordingly to provide a composition for the oxide surface layer such that, if it is produced by standard application processes, and including an annealing treatment, the good adhesion properties hitherto achievable between the oxide layer and the substrate, as well as the good thermal emissivity properties of the layer, are retained, if not exceeded. In addition, the structural make-up and the composition of the oxide layer is intended to make possible a simpler technical procedure for producing the layer, particularly with respect to smooth fusion, without troublesome evaporation and undesirable flowing of the oxide during the annealing treatment of the X-ray anode. The composition is also intended to prevent condensation or electrical flashovers in the X-ray tube.

DETAILED DESCRIPTION OF THE PREFERRED EMBODIMENTS

The object is achieved according to the invention by an X-ray anode, wherein the oxide coating contains 1–20% by weight of aluminum oxide, less than 20% by weight of titanium dioxide, and also more than 60% by weight of zirconium oxide.

When applied to an X-ray anode made of refractory metals, the oxide layer according to the invention has outstanding adhesion, smooth surfaces and a high thermal coefficient ("$\epsilon$") of approximately 0.80. This oxide layer, however, has the decisive advantage over the prior art in that, with otherwise comparable conditions, it is less liquid during the required annealing treatment of the anode, i.e., the viscosity of the melted oxide layer is higher than with hitherto known oxide layers upon fusion during the annealing treatment. Thus, the contours between surface parts with and without oxide coating do not become ill-defined. Evaporation and undesirable deposition of oxide constituents onto uncoated surface parts during the annealing process occurs only to a comparatively small extent. By matching the oxide composition, temperature and annealing treatment time, oxide layers having a desired surface roughness ($R_T$) of approximately 20 $\mu$m and exhibiting the surface appearance of an "orange peel" can be achieved.

X-ray rotary anodes are at present normally produced from the refractory metals tungsten, molybdenum or molybdenum alloys, and in particular from the carbon-containing alloy TZM.

Firstly, the oxide coating according to the invention contains the oxide components, hitherto already preferred, of zirconium oxide, calcium oxide and titanium oxide, for example in a ratio of 75:10:15. It is essential that the titanium dioxide is always present in proportions below 20% by weight of the oxide coating, and that zirconium oxide is provided in proportions of over 60% by weight of the oxide coating. The calcium oxide serves to stabilize the phase of the zirconium oxide component so that the zirconium oxide does not change phase during operation of the anode, and it may be partly or completely replaced by other stabilizing oxides known for such applications. Further, the calcium oxide component may be supplemented by small proportions of other thermally stable compounds, such as borides and/or nitrides.

Secondly, the residual proportion of the oxide coating composition, according to the invention, is aluminum oxide having a proportion by weight of the oxide coating of 1–20%, and preferably 4–7%.

The thickness of the oxide layer may vary between a few and a few thousand micrometers, depending on the deposition process employed.

Satisfactory deposition processes have been found to include the known PVD and CVD processes, and in particular plasma CVD processes and sputtering processes. Additionally, thermal coating processes such as, for example, plasma-jet spraying have also proven satisfactory. In the case of the oxide coating, the homogenous phase is understood as meaning a finely divided oxide mixture.

In the case of X-ray anodes made of molybdenum and standard molybdenum alloys, such as the molybdenum alloy TZM, a desired oxide layer structure and surface roughness, along with permanently good adhesion between layer and parent material, can advantageously be achieved by means of annealing at temperatures between 1,550° C. and 1,600° C. at an annealing time between 30 minutes and 1.5 hours.

The molybdenum alloy TZM contains small proportions of carbon which tends to be released at elevated temperatures. The carbon so released forms volatile CO or $CO_2$ with the oxygen components of the oxides composing the oxide layer, and as a result this leads to premature ageing of the oxide layer. If TZM is used as parent material, it is therefore advantageous in individual developments of the invention to arrange, between the parent material and the oxide layer, a diffusion barrier having a thickness of a few micrometers up to the region of millimeters, in the form of a monolayer of molybdenum, or a two-layer composite comprised of molybdenum and a suitable oxide.

The invention is explained in greater detail with reference to the illustrated example below.

EXAMPLE 1

An X-ray rotary anode composed of an alloy of molybdenum to which 5% by weight of tungsten has been added includes a W-Re layer, approximately 2 mm thick, in the focal track region. To increase the thermal radiation capability, this anode surface is provided with an oxide layer according to the invention.

For this purpose, a fully sintered and mechanically re-shaped X-ray anode is cleaned and roughened by sand blasting on the rear side of the anode to be coated, and as immediately as possible thereafter coated with an oxide powder under the standard process conditions, by means of plasma-jet spraying. The oxide powder applied has the following composition: a first component, comprising 89% by weight of the oxide coating, in the form of an oxide mixture composed of 72% by weight of $ZrO_2$, 8% by weight of CaO, 20% by weight of $TiO_2$; and furthermore a second component, comprising 11% by weight of the oxide coating, composed of $Al_2O_3$.

The rotary anode coated in this way has to be subjected to an annealing treatment in order to render it usable for use in X-ray tubes. As a result of the annealing treatment, the rotary anode, and in particular both the parent material and the coating material, is substantially freed of gas inclusions and of impurities which are volatile at elevated temperatures. Thus, electrical flashovers consequential to the release of gas inclusions during the subsequent use of the rotary anode in the high-vacuum X-ray tube are eliminated.

The degassing annealing, which is matched to the anode parent material, is carried out within a narrow temperature and time range in order to avoid undesirable structural changes in the parent material. On the other hand, the applied layer also has to be treated within a very specific temperature and time range, as a function of its composition, in order to achieve a fusion in the desired homogenous phase and to display a slightly shrivelled surface structure (i.e., the oxide layer displays a surface structure analogous to an "orange-peel").

In the present case, the annealing treatment is carried out at 1,620° C. for 65 minutes. The fused layer has the desired degree of blackening and also the required surface structure (i.e., an "orange-peel" layer). No uncontrolled flow of the fusing oxide layer occurs, and in particular not in the transition region between coated and uncoated parts of the rotary anode surface. Insofar as gaseous oxides evaporate from the layer surface during the annealing process, these do not deposit as troublesome layer condensation in the originally uncoated focal track region of the rotary anode.

The rotary anode was then tested in an X-ray tube experimental system under realistic conditions. It ran faultlessly there for several days within the required limit loading.

I claim:

1. An X-ray anode, in particular a rotary anode, of high thermal emissivity, said anode having a parent body made of a refractory metal or its alloys and a focal spot region or focal track region made of a refractory metal or its alloys, said anode having an oxide coating formed as a homogeneous, fused phase and deposited directly or via a base layer onto said parent body at least on parts of said anode surface outside said focal spot or focal track regions, wherein said coating comprises oxides of the metals Ti, Zr and Al, said oxide coating consisting essentially of 1–20% by weight of aluminum oxide, less than 20% by weight of titanium dioxide, and more than 60% by weight of zirconium oxide.

2. The X-ray anode as claimed in claim 1, wherein said oxide coating further comprises a stabilizing oxide component.

3. The X-ray anode as claimed in claim 2, wherein said stabilizing oxide component comprises CaO.

4. The X-ray anode as claimed in claim 3, wherein said oxide coating comprises:

a first component comprising 89% by weight of said oxide coating, said first component comprising a mixture of 72% by weight of $ZrO_2$, 8% by weight of CaO, and 20% by weight of $TiO_2$; and a second component comprising 11% by weight of said oxide coating said second component comprising $Al_2O_3$.

* * * * *